United States Patent [19]

Hardesty et al.

[11] 4,286,493

[45] Sep. 1, 1981

[54] GRADUATED LEVERAGE PIANO ACTION

[75] Inventors: Keith C. Hardesty, Whittier, Calif.; Gene L. Lukensmeyer, Orlando, Fla.

[73] Assignee: James R. Wales, Longwood, Fla.

[21] Appl. No.: 119,489

[22] Filed: Feb. 7, 1980

[51] Int. Cl.[3] ..... G10C 3/18

[52] U.S. Cl. ..... 84/237; 84/439

[58] Field of Search ..... 84/236, 237, 239, 243, 84/247, 248, 249, 433, 439, 440

[56] References Cited

U.S. PATENT DOCUMENTS

| | | | |
|---|---|---|---|
| 351,477 | 10/1886 | Stroud | 84/439 |
| 619,964 | 2/1899 | Kringle | 84/439 |
| 777,133 | 12/1904 | Olsson | 84/439 |
| 959,716 | 5/1910 | Charpiat | 84/239 |
| 1,224,994 | 5/1917 | Anelli | 84/439 |
| 1,353,905 | 9/1920 | Gertz | 84/239 |
| 2,466,498 | 4/1949 | Smith | 84/239 |
| 3,559,526 | 2/1971 | Raffali | 84/440 |

*Primary Examiner*—L. T. Hix
*Assistant Examiner*—Alan Mathews
*Attorney, Agent, or Firm*—Duckworth, Hobby, Allen, Dyer & Pettis

[57] ABSTRACT

A graduated leverage piano action is incorporated into a piano having graduated mass hammers for striking graduated mass strings. The mass of the hammers and strings is highest for the lowest bass strings and lowest for the highest treble strings. In the piano a plurality of keys are supported by and pivoted about a balance rail which divides each key into first and second lever arms. The length of the second lever arm is defined by the location of a capstan screw which is coupled to each key. The length of the second lever arm decreases as the mass of the hammers increases. A complex mechanical linkage is coupled to each hammer and is positioned above each capstan screw for displacing each hammer when contacted by an opposing capstan screw contacts the third lever arm. The third lever arm is displaceable by the corresponding capstan screw. The length of the third lever arm increases as the length of the second lever arm decreases so that the force required to displace any piano keys remains substantially constant across the entire keyboard.

15 Claims, 3 Drawing Figures

GRADUATED LEVERAGE PIANO ACTION

BACKGROUND OF THE INVENTION

1. Field of the Invention

The present invention relates to pianos, and more particularly, to pianos having lever action piano keys which are coupled to displace variable mass hammers for striking variable mass piano strings.

2. Description of the Prior Art

The prior art discloses many different structures which are intended to vary the force required to cause a hammer to strike a piano string. This process is generally referred to as lightening the touch of the piano. U.S. Pat. No. 1,224,994 (Anelli) discloses a specific piano keyboard design which permits the balance rail to be displaced fore and aft to move the pivot point of all piano keys in unison to modify the touch of a piano. In this embodiment, the length of both piano key lever arms is modified as the balance rail if repositioned. Adjustment of the balance rail position permits the touch of the piano to either be increased or decreased.

U.S. Pat. No. 777,133 (Olsson) discloses an improvement for a pipe organ which permits the organ key fulcrum point to be modified to vary the force required to open a selected organ valve. The fulcrum point for each organ key can be individually adjusted to provide the desired feel.

U.S. Pat. No. 619,964 (Kringel) discloses a touch regulator for a piano action. FIG. 8 and the last column of the disclosure of this patent specifically relates to modifying the touch or feel of a grand piano action. Pringle discloses a user-adjustable system which horizontally displaces a series of weights of predetermined distance. A single weight is coupled to the rear side of each piano key and simultaneously displaces all piano key weights a uniform distance by the user-controlled adjusting rod in order to modify the playing forces of all keys simultaneously.

U.S. Pat. No. 2,466,498 (Smith) discloses a grand piano action which includes a pivotable knuckle to reduce the friction between the hammer and the hammer displacing escapement. The Smith patent also discloses a spring which is coupled to the hammer and to the hammer actuating structure. This spring provides an upward biasing force which reduces the hammer actuating force and thereby modifies the touch of the piano.

The following techniques are well known to those skilled in the art and are intended to reduce the touch of the piano action. Moving lead weights disposed within the interior of the ivory covered ends of the piano keys; adding or substracting lead from the piano keys; elevating the damper lever; filing felt from the piano hammers to reduce the overall mass of the piano hammers; reducing the tension on the repetition spring; and elevating the capstan screw. Each of these prior art techniques accomplishes its purpose to a limited extent, but typically also reduces the performance of the piano. For example, filing felt from a piano hammer makes the hammer felt harder and smaller than desired. Reducing the tension of the repetition spring causes the repetition to be less certain. Elevating the capstan raises the hammer line and therefore reduces the hammer throw. Adding lead to a piano key increases the inertia of the piano key and reduces the speed of the hammer return, substantially affecting the playing characteristics or the piano.

In present day grand pianos the lowest bass key requires a fifty gram force to actuate the hammer, while the hammer commences a return movement to its resting position when the key deflecting force is reduced to eighteen grams. At the highest treble key, these factors are changed as follows: 38 grams down/24 grams up.

The playing forces recited above for a grand piano are substantially in excess for the playing forces for an upright piano in which the hammers are deflected horizontally and are not elevated against the force of gravity as is the case with a grand piano. For that reason, non-professional musicians have greatly difficulty playing a grand piano well. Professional musicians must practic four to five hours each day to maintain their hand and finger muscles in a state which can properly actuate the keys in a grand piano. A second disadvantage of a grand piano which is not nearly as evident as in an upright piano is that the playing forces described above vary from fifty grams at the low end of the scales to 38 grams at the high end of the scale. This varying playing force makes it extremely difficult for anyone but a highly experiences, professional pianist to maintain a uniform dynamic range as the piano is played or to produce a wide dynamic range.

SUMMARY OF THE INVENTION

It is therefore a primary object of the present invention to provide a graduated leverage piano action particularly suitable for a grand piano which will substantially reduce the playing forces and will render the playing forces substantially equal from the low end to the high end of the piano keyboard.

Another object of the present invention is to provide a graduated leverage piano action which will permit non-professional pianists to play a grand piano substantially as well as they are able to play an upright piano.

Yet another object of the present invention is to provide a graduated leverage piano action which can inexpensively be incorporated into new or existing grand pianos without substantial structural modifications.

Still another object of the present invention is to provide a graduated leverage piano action which by reducing the overall touch forces and by making the touch forces at one end of the keyboard substantially equal to the touch forces at the other end of the keyboard will dramatically increase a pianist's ability to widen the dynamic playing range.

Briefly stated, and in accord with one embodiment of the invention, a graduated piano leverage action is incorporated within a grand piano having graduated mass hammers for striking graduated mass strings. In this piano the mass of the hammers and strings is highest for the lowest bass strings and lowest for the highest treble spring. In the graduated leverage piano action, a plurality of keys are pivotable about a balance rail which divides each key into first and second lever arms. The length of the second lever arms is defined by the location of a capstan screw which is coupled to each key. The length of the second lever arm decreases as the mass of the hammers increases. Means is coupled to each hammer and is positioned above each capstan screw to displace the hammer when contacted by the opposing capstan screw. The displacing means includes a third lever arm having a length defined by the point at which the capstan screw contacts the third lever arm. The length of the third lever arm increases as the length of the second lever arm decreases so that the force required to displace the piano keys remains substantially constant across the piano keyboard.

DESCRIPTION OF THE DRAWINGS

The invention is pointed out with particularity in the appended claims. However, other objects and advantages together with the operation of the invention, may be better understood by reference to the following detailed description taken in connection with the following illustrations wherein:

DESCRIPTION OF THE PREFERRED EMBODIMENT

Figures 1, 2, 3:
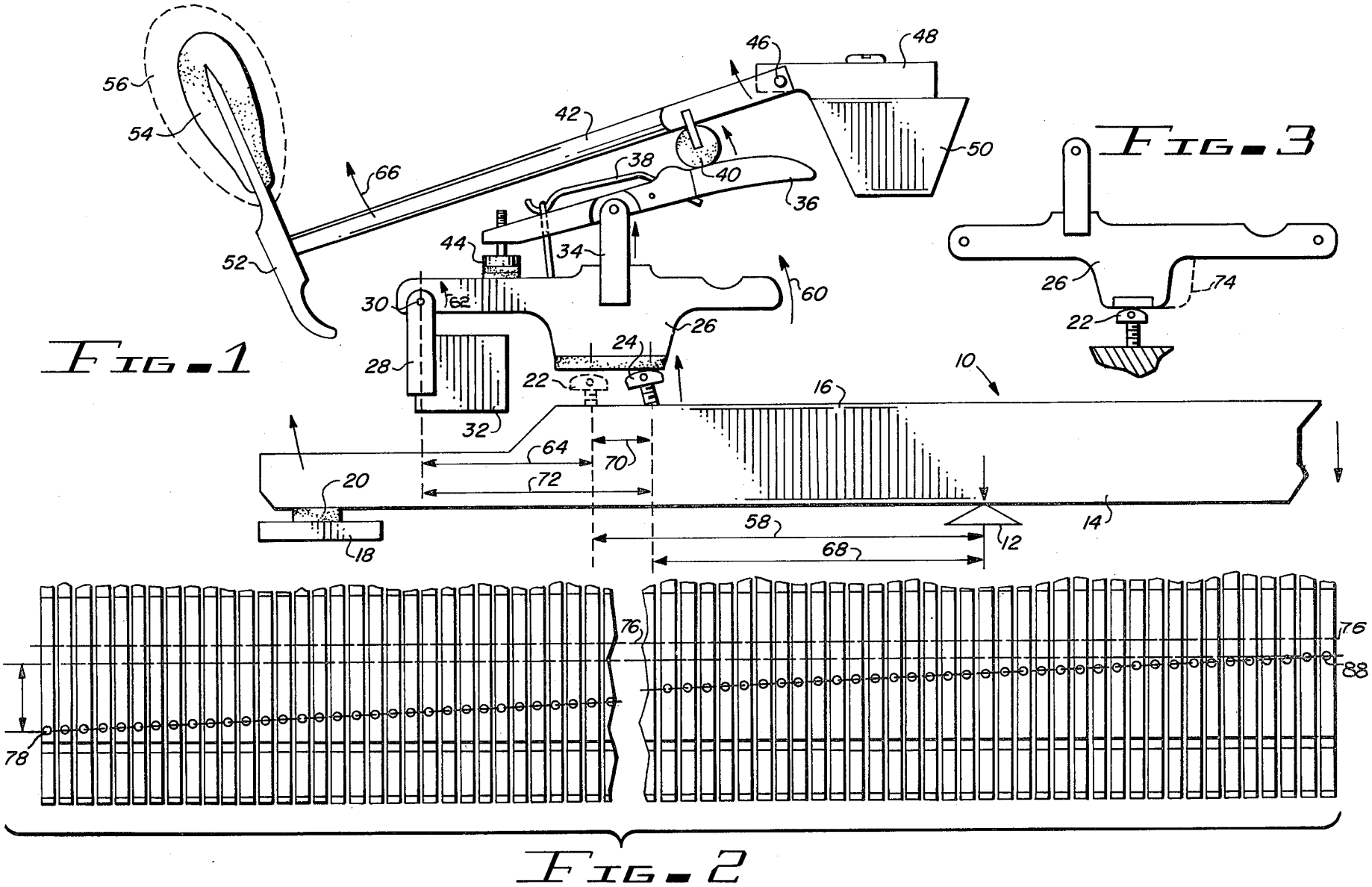
FIG. 1 is a partial sectional view of a section of a grand piano action.
FIG. 2 is a view from above of the rear segment of the piano keys, particularly illustrating the graduated placement of capstan screws with respect to the piano keys from the low end to the high end of the keyboard.
FIG. 3 illustrates a whippen of the type typically incorporated in present day grand piano actions.

In order to better illustrate the advantages of the invention and its contribtions to the art, a preferred hardware embodiment of the invention will now be described in some detail.

Referring now to FIG. 1, a partial sectional view of a portion of a grand piano action is illustrated. Numerous elements which are typically incorporated within this section of the grand piano action have been deleted for the purpose of simplifying the explanation of the graduated leverage piano action.

A piano key 10 pivots about balance rail 12. For the purpose of the present discussion the section of key 10 lying to the right of balance rail 12 will be referred to as first lever arm 14, while a selected portion of the section of key 10 lying to the left of balance rail 12 will be referred to as second lever arm 16. In the unactuated position illustrated in FIG. 1, the left hand side of key 10 rests on back rail 18 and key rest felt 20. A single capstan screw, such as capstan screw 22 or capstan screw 24, transfers upward displacements of lever arm 16 to a whippen 26.

Whippen 26 is pivotally coupled to whip 28 by the shaft indicated by reference number 30. Whip 28 is coupled to and supported by ship rail 32. A repetition lever flange 34 couples whippen 26 to repetition lever 36. A repetition lever spring 38 has one end coupled to repetition lever 36 and the other end coupled by a piece of string to the upper surface of whippen 26. Repetition lever spring 38 serves to maintain the right hand side of repetition lever 36 biased against knuckle strip 40 which is coupled to hammer shank 42. Button fly 44 maintains repetition lever 36 in the position illustrated in FIG. 1 when key 10 is in the resting position.

Knuckle strip 42 is pivotally coupled by center pin 46 to hammer shank flange 48. Hammer shank flange 48 is coupled to and supported by hammer shank rail 50. A hammer 52 is coupled to the opposite end of hammer shank 42 and includes a hammer felt 54 which actually contacts a selected string of the piano. The dotted line indicated by reference number 56 serves to illustrate the shape and configuration of a hammer felt which is coupled to the hammers opposing base strings while hammer felt 54 illustrates the size of a hammer felt which impacts higher frequency treble strings.

Capstan screw 22 represents an outline of the positioning of a capstan screw on prior art grand piano actions. The dimension line designated by reference number 58 indicates the effective length of second lever arm 16 which is defined by the distance between balance rail 12 and capstan screw 22. When the right hand side of key 10 is actuated and causes second lever arm 16 to be elevated, capstan screw 22 contacts the lower felt surface of whippen 26, causing whippen 26 to be displaced upward as indicated by reference number 60. Reference number 62 illustrates the pivotal displacement of whippen 26 with respect to shaft 30. The distance between the contact point of capstan screw 22 with the felt pad of whippen 26 and shaft 30 defines a third lever arm which is indicated by dimension line 64.

The upward rotation of whippen 26 with respect to shaft 30 also elevates repetition lever flange 34 and causes repetition lever 36 to be upwardly pivotted against knuckle strip 40. This upward movement of knuckle strip 40 causes hammer 52 to be displaced in the direction indicated by arrow 66 and eventually causes hammer felt 54 or 56 to strike an appropriate piano string.

At the base end of the keyboard where hammer felts, such as hammer felt 56, are larger in size and larger in mass, the force reqired by a pianist to actuate hammer 52 can be reduced and made equal to the actuation force for high treble keys where a hammer felt has the mass and size indicated by hammer felt 54 in FIG. 1.

This significant modification of the piano key actuation force is accomplished in accordance with the present invention by removing capstan screw 22 from the position illustrated in FIG. 1 and shifting it to the location illustrated in bold lines by reference number 24. In this modified configuration, second lever arm 16 is reduced in length as is indicated by dimension line 68. The shift distance between the old and new positions of capstan screw 24 is illustrated by the dimension line idenfified by reference number 70. The length of the third lever arm is increased from the previous length indicated by reference number 64 to the modified, longer length indicated by reference number 72. Since the proportional change in length of second lever arm 16 is comparatively small and proportional change in length of the third lever arm is comparatively large, a substantial increase in mechanical advantage is realized. This substantially increased mechanical advantage produced by the lengthening of the third lever arm reduces the force required by the player to actuate key 10 and to thereby upwardly displace repetition lever flange 34.

In order to reposition capstan 24 as illustrated it is typically necessary to modify the shape of whippen 26. FIG. 3 illustrates a typical existing whippen 26 and capstan screw 22. A small felt pad provides the direct contact between the upper surface of capstan screw 22 and the lower surface of whippen 26. Since in accordance with the present invention capstan screw 22 is shifted to the right, it is typically necessary to replace whippen 26 or to increase the width of the lower section of whippen 26 in the manner indicated by dotted lines 74. This modified structure of whippen 26 and the felt positioned thereon is illustrated in FIG. 1.

Referring now to FIG. 2, a view from above of the rear surface of a plurality of keys is illustrated. The horizontal dotted line indicated by reference number 76 illustrates the position of prior art capstan screws 22 on the rear sections of the keys illustrated. In accordance with the present invention, capstan screws 24 are shifted toward balance rail 12 a variable distance which varies directly as the mass of the hammer felt for a particular key. The capstan screw position for the lowest base key is designated by reference number 78. This bas key capstan screw is moved the greatest distance toward balance rail 12. For typical grand pianos, this capstan screw displacement is generally on the order of five sixteenths of an inch from the prior location illustrated by dotted line 76. For the highest treble key, capstan screw 24 can either be left in place or moved a very slight distance to a new position illustrated by reference number 80. Reference number 80 illustrates that this particular capstan screw can be moved forward up to about three sixteenths of an inch from the previous position illustrated by dotted line 76. For the eighty six keys intermediate to the lowest and highest frequency keys, the capstan screw position is generally determined by placing a straight edge between the points indicated by reference numbers 78 and 80 and inscribing a line across the remainder of the keys. The capstan screws for these intermediate keys are then positioned as illustrated in FIG. 2.

In certain installations, it may be desirable to position the capstan screws lying between the positions illustrated by reference number 78 and 80 in a configuration other than in a straight line in order to accomplish the purpose of equalizing the actuating forces for all keys to the maximum extent possible.

In a prior art grand piano modified to the configuration illustrated in FIGS. 1 and 2, the actuation force of the lowest bass key can be reduced from fifty grams to forty grams while the return force remains constant at eighteen grams. The actuation force for the highest treble key is maintained at about thirty eight grams while the return force remains constant at about twenty four grams. As a result of the foregoing modifications the piano key actuation force differential between the low and high end of the keyboard can be reduced from fifty to forty grams which is virtually equal to the minimum thirty eight gram actuation force required for the highest key.

The technique of the present invention differs radically from prior art devices which modify the leverage for all piano keys by a given uniform distance. Because the preferred embodiment of the present invention virtually equalizes the actuation force of the various piano keys, less experienced non-professional pianists can more readily play a grand piano since the actuation forces are more nearly the same as the reduced playing forces available on upright pianos. In addition, since the actuation force differential between lower keys and higher end keys have been virtually eliminated, it is possible for all pianists to substantially increase their dynamic range in comparison with prior art grand pianos. Although precisely the same modification to prior art upright pianos can be made, the performance differential is far less perceptible since actuation forces for an upright piano are substantially less than those of a grand piano. With a grand piano since the movement of the hammer actuation mechanism occurs in the vertical plane in opposition to the force of gravity, all forces are generally greater than those in an upright piano where the hammer actuation displacements occur in a horizontal plane and little gravitational opposition is encountered.

Since the repositioning of capstan screw 24 as taught above shortens second lever arm 16 of piano key 10, the aftertouch engagement distance of key 10 is slightly modified. To compensate and return the after touch distance to what it had been before, it may be necessary to elevate capstan screw 24 very slightly above the prior art position indicated by reference number 22. This elevation of capstan screw 24 is illustrated in FIG. 1. Elevating capstan screw 24 reduces the distance between hammer 42 and the piano string by about one eighth to three sixteenths of an inch and repositions the after touch engagement point to the desired location. It may also be desirable to slightly vertically incline capstan screw up to about an eight degree angle as illustrated in FIG. 2, particularly when a prior art whippen of the type illustrated in FIG. 3 is utilized without modification.

It will be apparent to those skilled in the art that the disclosed graduated leverage piano action may be modified in numerous ways and may assume many embodiments other than the preferred form specifically set out and described above. Accordingly, it is intended by the appended claims to cover all such modifications of the invention which fall within the true spirit and scope of the invention.

We claim:

1. A graduated leverage piano action for a grand piano having graduated mass hammers for striking graduated mass string wherein the mass of the hammers and strings is highest for the lowest bass strings and lowest for the highest treble strings, comprising:

a. a plurality of keys pivotable about a balance rail which divides each key into first and second lever arms wherein the length of the second lever arms is defined by the location of a capstan screw which is coupled to each key and wherein the length of the second lever arm decreases as the mass of the hammers increases; and b. means coupled to each hammer and positioned above each capstan screw for displacing a selected hammer when contacted by one of said capstan screws, said displacing means including a third lever arm having a length defined by the point at which said one capstan screw contacts said third lever arm and being displaceable by said one capstan screw, wherein the length of said third lever arm increases as the length of said second lever arm decreases, whereby the force required to displace a piano key remains substantially constant across the piano keyboard.

2. The graduated leverage piano action of claim 1 wherein the sum of the lengths of the second and third lever arms is constant across the piano keyboard.

3. The graduated leverage piano action of claim 2 wherein each said capstan screw is inclined at an angle to the vertical axis of the piano key.

4. The graduated leverage piano action of claim 3 wherein said capstan screw is inclined at an eight degree angle with respect to the vertical axis of said piano key.

5. The graduated leverage piano action of claim 2 wherein the elevation of the head of each of said capstan screws can be altered to modify the after touch of any selected key.

6. The graduated leverage piano action of claim 2 wherein said third lever arm includes a whippen and wherein the point at which the capstan screw contacts the lower surface of said whippen defines the length of the third lever arm.

7. In a piano having a plurality of strings and a plurality of keys for actuating a plurality of hammers to strike each of the strings where each key is pivotable about a balance rail which divides the key into first and second lever arms and where the piano includes means interposed between each key and each hammer for causing a displacement of each key to actuate a corresponding hammer to strike a corresponding string, the improvement comprising:

a. a graduated leverage piano action having a capstan screw coupled to each key at a point which defines the length of the second lever arm so that the length of the second lever arm is shortest for the lowest bass key which actuates the highest mass hammer, the length of the second lever arm is the longest for the highest treble key which actuates the lowest mass hammer, and the lengths of the second lever arms positioned between the longest and shortest second lever arms progessively increase in length from the bass to the treble keys.

8. The piano of claim 7 wherein the piano is a grand piano and wherein the actuating means is displaced vertically upward by displacements of each key.

9. The piano of claim 8 wherein each capstan screw is inclined at an angle with respect to the vertical axis of each key.

10. The piano of claim 8 wherein the length differential between the longest second lever arm and the shortest second lever arm is less than one inch.

11. In a piano having a plurality of strings and a plurality of keys for actuating a plurality of hammers to strike each of the strings, and where each key is pivotable about a balance rail which divides the key into first and second lever arms and where the piano includes means interposed between each key and each hammer for causing a displacement of each key to actuate a corresponding hammer to strike a corresponding string, the improvement comprising:

a. forming a graduated leverage piano action by positioning capstan screws which define the length of the second lever arm of each key so that the length of the second lever arm is shortest for the lowest bass key which actuates the highest mass hammer, the length of the second lever arm is the longest for the highest treble key which actuates the lowest mass hammer, and the lengths of the lever arms positioned between the longest and shortest second lever arms progessively increase in length from the lowest bass to the highest treble keys.

12. The piano of claim 11 wherein the piano is a grand piano and wherein the actuating means is displaced vertically upward by displacements of each key.

13. The piano of claim 12 wherein each capstan screw is inclined at an angle with respect to the vertical axis of each key.

14. The piano of claim 12 wherein the length differential between the longest second lever arm and the shortest second lever arm is less than one inch.

15. The piano of claim 11 wherein the shift in capstan screw positions between adjacent keys is constant across the piano keyboard.

* * * * *